US005298957A

United States Patent [19]

Haupt et al.

[11] Patent Number: 5,298,957

[45] Date of Patent: Mar. 29, 1994

[54] FUSER ROLL APPARATUS HAVING A HEAT STABILIZING COLLAR

[75] Inventors: George J. Haupt, Williamson; Robert Pugh, Jr., Webster, both of N.Y.

[73] Assignee: Xerox Corporation, Stamford, Conn.

[21] Appl. No.: 981,662

[22] Filed: Nov. 25, 1992

[51] Int. Cl.[5] ..... G03G 15/20

[52] U.S. Cl. ..... 355/285; 118/60; 219/216

[58] Field of Search ..... 355/282, 285, 289, 290; 219/216; 118/60

[56] References Cited

U.S. PATENT DOCUMENTS 4,595,274 6/1986 Sakurai ..... 355/290
4,618,240 10/1986 Sakurai et al. ..... 219/216
4,813,372 3/1989 Kogure et al. ..... 118/60

*Primary Examiner*—A. T. Grimley
*Assistant Examiner*—Sandra L. Brasé
*Attorney, Agent, or Firm*—Finnegan, Henderson, Farabow, Garrett & Dunner

[57] ABSTRACT

An fuser apparatus for minimizing heat transfer between an end of a fuser roll and a fuser bearing includes a generally cylindrical fuser collar positioned between one end of the fuser roll and one of the fuser bearings and having an outer surface contacting the fuser bearing and an inner surface contacting the fuser roll. A plurality of protrusions are formed on either the inner surface or outer surface of the collar to reduce the heat transfer between the fuser roll and fuser bearing. Grooves supporting O-rings may also be formed in the collar or in an end of the fuser roll for allowing the fuser roll to move axially relative to the collar.

16 Claims, 3 Drawing Sheets

FUSER ROLL APPARATUS HAVING A HEAT STABILIZING COLLAR

BACKGROUND OF THE INVENTION

1. Field of the Invention

This invention relates generally to xerographic apparatus, and particularly relates to fusers used in the xerographic process.

2. Discussion of the Related Art

The basic xerographic process includes exposing a charged photoconductive member to a light image of an original document. The irradiated areas of the photoconductive surface are discharged to record an electrostatic latent image corresponding to the original document. A development system moves a developer mix of carrier granules and toner particles into contact with the photoconductive surface. The toner particles are attracted electrostatically from the carrier granules to the latent image, forming a toner powder image thereon. The toner powder image is then transferred to a sheet of paper or other support material. This sheet of paper advances to a fuser which permanently affixes the toner powder image to the paper.

Conventional fusers generally included a rotatable fuser roll and pressure roll supported by a frame. The ends of the fuser roll were supported on the frame by cylindrical bearings. The bearings were provided with a lubricant to reduce wear.

In order to permanently affix the toner powder image to the sheet, the fuser roll was heated to a temperature of approximately 350° F. A circumferential surface of the pressure roll was brought into contact with a circumferential surface of the fuser roll to form a nip in which a sheet carrying a toner powder image passed through. The fuser roll was rotated to pull the sheet carrying the toner powder image through the nip between the pressure roll and the fuser roll. The combination of heat and high loads exerted between the pressure roll and fuser roll permanently affixed the toner powder image to the sheet.

In prior applications, the fuser roll had to be heated to its operating temperature each time the copier was used. This resulted in delay times for users waiting to use the copier. In order to increase the efficiency of the copiers, the fuser roll was maintained at the operating temperature of approximately 350° F. during the standby mode. As a result, a user could promptly use the machine without waiting for the fuser roll to be heated to the desired operating temperature.

The maintaining of the fuser roll at a temperature of approximately 350° F., while reducing down time, caused problems due to the heat transfer between the fuser roll and the bearings. The lubricant contained in the bearings could not handle high temperatures for extended periods of time. As a result, the lubricant broke down, thereby increasing wear on the bearings and reducing bearing life.

In an attempt to remedy this problem, metal collars were mounted on the ends of the fuser roll between the fuser roll and the bearings to reduce wear. However, significant heat transfer between the fuser roll and the collar still caused the lubricant to break down.

The metal collars also damaged the ends of the fuser roll. Relative motion occurred due to the difference in diameters between the fuser roll and the collar. This caused the ends of the fuser roll to scrape against the inner surface of the collar during operation, thereby reducing both fuser roll and collar life.

In an attempt to reduce the wear caused by relative motion and heat transfer, plastic collars were used in place of the metal collars. The plastic collars contained a land which engaged a notch formed on the end of the fuser roll to prevent relative motion. However, since the contact between the pressure roll and the fuser roll generated high loads exceeding 100 pounds, the high loads sheared the land of the plastic collar during operation. The plastic collars also did not significantly reduce the heat transfer between the fuser roll and the bearings.

An additional problem occurred when the fuser roll was initially heated to its operating temperature. The heating caused the fuser roll to expand in both the radial and axial directions. This radial and axial expansion produced great stress on the fuser bearings, sometimes causing the fuser bearings to fall out of the fuser frame supporting the fuser roll. Axial expansion of the fuser roll also caused the fuser roll to slide on the fuser bearings, thereby causing wear on the fuser roll. Additionally, the sliding of the metal fuser roll on a metal fuser bearing sometimes generated unwanted noise during operation.

SUMMARY OF THE INVENTION

Accordingly, it is an object of the present invention to provide an apparatus for reducing fuser roll and fuser bearing wear when a fuser roll is constantly maintained at its operating temperature.

It is another object of the present invention to provide an apparatus which reduces wear on the ends of the fuser roll due to relative motion between the fuser roll and a collar.

It is another object of the present invention to provide an apparatus which reduces wear on the ends of the fuser roll and the fuser bearings due to the thermal expansion of the fuser roll.

It is another object of the present invention to provide an apparatus which prevents loss of fuser bearings from falling out of the fuser frame during thermally induced axial expansion of the fuser roll.

It is a further object of the present invention to provide an apparatus which eliminates noise generated by contact between the fuser bearing and the fuser roll during thermal axial expansion of the fuser roll.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, a fuser roll collar comprises a generally cylindrical collar positionable between the end of the fuser roll and the fuser bearing, the collar having an outer surface contacting the fuser bearing and an inner surface contacting the fuser roll, and a plurality of protrusions formed on one of the inner surface and outer surface of the collar to reduce heat transfer between the fuser roll and the fuser bearing.

In another aspect of the invention, a fuser apparatus comprises a frame, a rotatable fuser roll having a longitudinal axis and ends supported by the frame, a cylindrical bearing circumscribing each end of the fuser roll for rotatably supporting the fuser roll on the frame, a generally cylindrical collar positioned between one end of the fuser roll and one of the cylindrical bearings, and sliding means, disposed between the collar and the one end of the fuser roll, for allowing the fuser roll to move axially relative to the collar.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENT

Reference will now be made in detail to the present preferred embodiments of the invention, examples of which are illustrated in the accompanying drawings. Wherever possible, the same reference numbers will be used throughout the drawings to refer to the same or like parts.

Figure 2A:
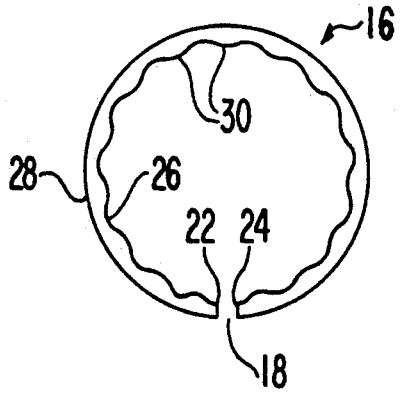
FIGS. 2A–2C are cross-sectional end views of several embodiments of the fuser roll collar of the present invention.
Figure 2B:
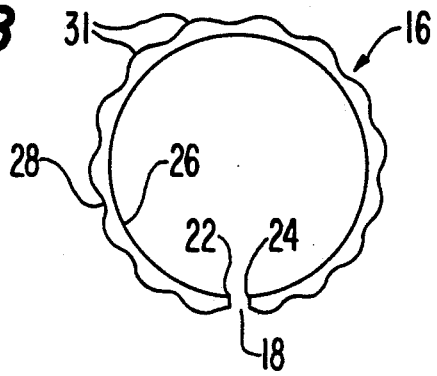
Figure 2C:
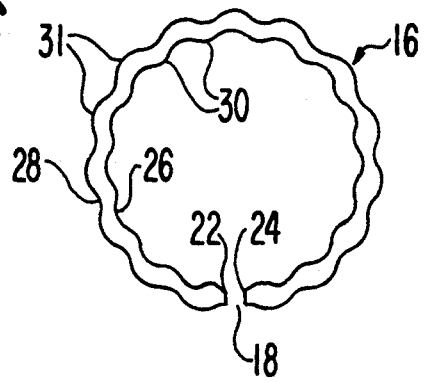
Figure 3:
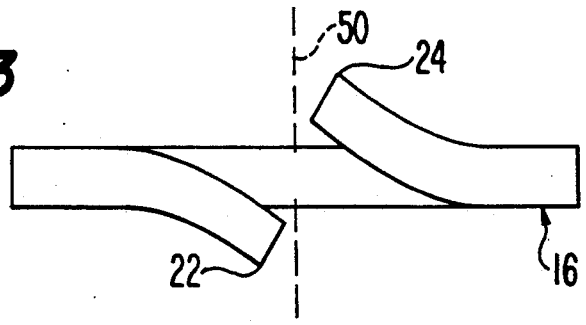
FIG. 3 is a side view of the fuser roll collar of the present invention.

FIGS. 2A–2C illustrate several embodiments of the fuser roll collar of the present invention. The fuser roll collar 16 is generally cylindrically shaped and has an inner diameter which is slightly greater than the outer diameter of a fuser roll. The collar 16 is split at 18 to form ends 22,24. The ends 22,24 are preferably twisted so that the ends 22,24 are displaced in opposite directions along a longitudinal axis, which is generally designated by the reference numeral 50, of the collar, as shown in FIG. 3. The splitting of the collar at 18 enables the collar to be easily mounted on the ends of the fuser roll and also allows for some thermally induced axial expansion of the fuser roll. The twisting of the ends 22, 24 of the fuser collar serves to lock the fuser collar in place when the collar is pushed onto the end of the fuser roll, thereby reducing relative motion between the fuser collar and the fuser roll.

Referring to FIG. 2A, the collar 16 has an inner surface 26 and an outer surface 28. The inner surface 26 is formed having a plurality of protrusions 30 spaced along the inner circumference. The protrusions 30 are hemispherically shaped; however, other shapes for the protrusions may be used. For example, the protrusions may also have parabolic or triangular cross-sections. The protrusions 30 may also be formed on the outer surface 28, as shown in FIG. 2B, or on both the inner and outer surfaces of the collar, as shown in FIG. 2C, to further decrease the thermal path between the fuser roll and the bearings.

Figure 4:
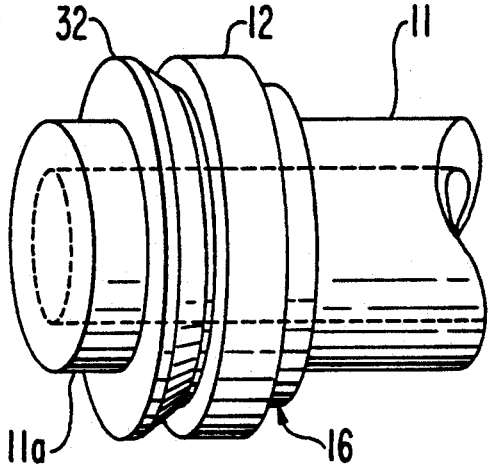
FIG. 4 is a front view of an end of a fuser roll, including a fuser bearing and the fuser roll collar of the present invention.

As shown in FIG. 4, the outer surface 28 includes a flared surface portion 32 formed on one edge of the fuser roll collar 16. The flared surface portion 32 is designed to retain a fuser bearing 12 on the outer surface 28 of the fuser roll collar 16.

In the illustrated embodiments, the fuser roll collar 16 is composed of an aluminum alloy which is ductile and easy to machine. A 6061T6 aluminum alloy is preferably used.

Figure 1:
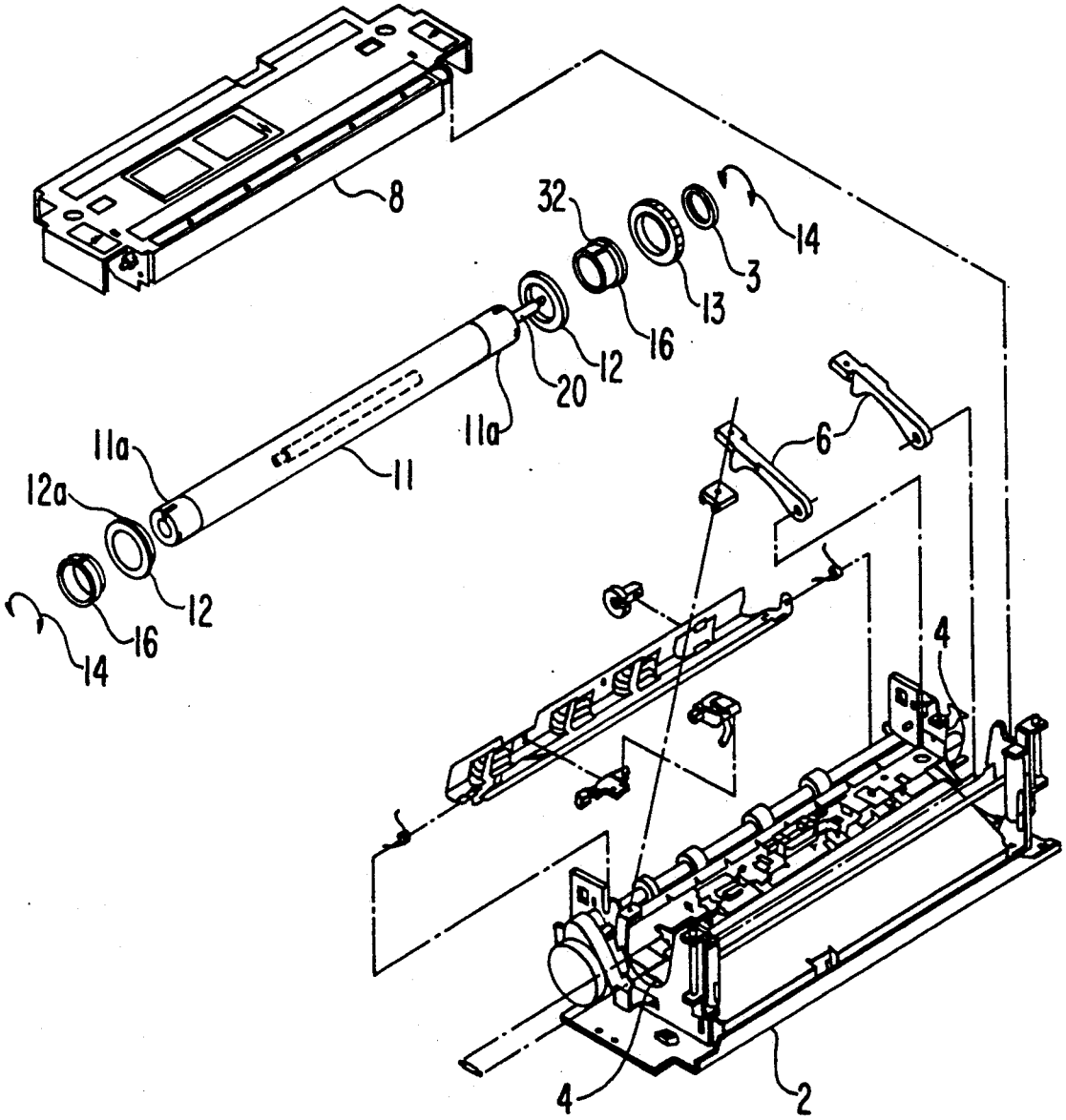
FIG. 1 is an exploded view of a fuser assembly in which the fuser roll collar of the present invention is used.

A fuser assembly in which the present invention is used is illustrated in FIG. 1. The fuser assembly is used in copiers, such as the Model Nos. 5028, 5018, and 5034 copiers manufactured by Xerox Corporation. The fuser assembly may also be used in any copier or machine requiring a fuser, such as facsimile machines and printers.

As shown in FIG. 1, the fuser roll 11 is a hollow cylindrical member rotatably mounted on a frame 2. The fuser roll 11 is hollow to support a heat rod 20 within the fuser roll 11. The heat rod 20 acts to uniformly heat the fuser roll 11 during operation.

Ends **11*a* of the fuser roll 11 are rotatably supported on supports 4 of the frame 2 by cylindrical bearings 12. The bearings 12 have an inner race which is fixedly mounted on the outer surface of the fuser collar and an outer race. Ball bearings are supported between the inner race and outer race of the cylindrical bearing 12 to allow the fuser roll collar 16 and the fuser roll 11 to rotate relative to the outer race of the bearing 12. A lubricant is also included between the inner race and outer race of the bearings to reduce friction as the fuser roll and fuser collar rotate. FIG. 4 illustrates the positioning of the bearings 12 and fuser roll collar 16 on the ends 11*a* of the fuser roll 11. As shown in FIG. 1, an outer surface of the bearing 12 contains a groove 12*a* which engages the support 4 to help prevent axial movement of the fuser roll 11**.

As shown in FIG. 1, a fuser roll gear 13 is also mounted on the outer surface 28 of one of the fuser roll collars 16 with a spacer 3. The fuser roll gear 13 is driven by a motor (not shown) to rotate the fuser roll 11. Retaining rings 14 hold the bearings 12, collars 16, and gear 13 on the ends **11*a* of the fuser roll 11**.

When the fuser roll 11 is positioned on the frame 2, the bearings 12 are held on the supports 4 with bearing clamps 6. The fuser roll 11 is supported on the frame 2 so that a circumferential surface of a pressure roll (not shown) can be moved into contact with the circumferential surface of the fuser roll 11. A web assembly 8 may also be mounted on the frame 2 above the fuser roll 11. The web assembly 8 removes excess toner and other residue from the circumferential surface of the fuser roll 11 by bringing an absorbent web into contact with the fuser roll 11.

In operation, the fuser roll 11 is heated to a temperature of approximately 350° F. by heating the heat rod 20. Since only the protrusions 30 on the inner surface 26 of the fuser collar 16 contact the end **11*a* of the fuser roll 11, less surface area of the fuser collar 16 contacts the fuser roll 11. As a result, the thermal path from the fuser roll 11 to the fuser bearing 12 through the collar is decreased. Therefore, the heat transfer between the fuser roll 11 and the bearing 12** is greatly reduced, thus reducing bearing lubricant loss and increasing bearing life.

The illustrated embodiments show collars 16 disposed on each end **11*a* of the fuser roll 11. However, the collar 16** need only be used on the end of the fuser roll 11 containing the gear 13 since this end is heated to a higher temperature.

Figure 5:
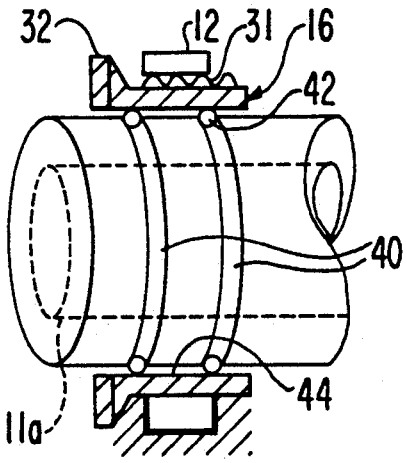
FIGS. 5 and 6 are front cut-away views of two embodiments of the fuser roll collar of the present invention.

In an additional embodiment of the present invention, the fuser roll assembly may include sliding means for allowing the fuser roll to move in a direction parallel to its longitudinal axis relative to the collar. As illustrated in FIG. 5, the sliding means includes two circumferential grooves 40 in ends 11*a* of the fuser roll. The grooves 40 support O-ring seals 42 which allow the fuser roll 11 to freely slide on the O-rings 42 rather than the inner surface 26 of the fuser collar 16 when the fuser roll 11 expands axially due to heating. A high temperature silicone grease is placed between the two O-ring seals 42 at a location designated by reference numeral 44 to fill the gap between the fuser roll and the fuser collar. The silicone grease further decreases friction between the fuser roll collar 16 and the O-rings 42.

Figure 6:
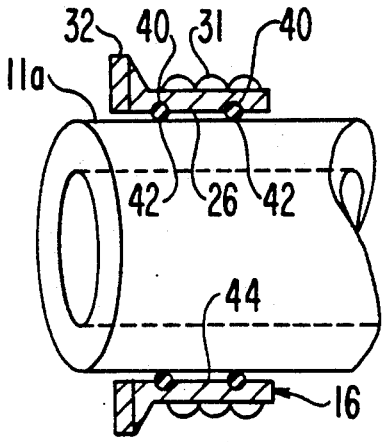

A further embodiment of the sliding means is illustrated in FIG. 6. The embodiment shown in FIG. 6 differs from the embodiment shown in FIG. 5 in that grooves 46 are formed in the inner surface 26 of the fuser roll collar 16 rather than on the ends 11*a* of the fuser roll 11. O-ring seals 42 are supported in these grooves to allow the fuser roll to expand axially without rubbing against the fuser collar 16 and causing wear and unwanted noise or knocking the bearings 12 out of the supports 4 on the frame 2. Again, a high temperature silicone grease is applied between the O-rings at location 44 to fill the gap between the fuser roll and fuser roll collar.

In both of the embodiments shown in FIGS. 5 and 6, protrusions 31 are formed on the outer surface 28 of the fuser roll collar 16 rather than on the inner surface 26. As a result, the protrusions 31 contact the inner surface of the fuser bearing 12 to minimize the heat transfer between the fuser roll collar 16 and the fuser bearing 12. The fuser roll collar is also not split in the embodiments shown in FIGS. 5 and 6.

It will be apparent to those skilled in the art that various modifications and variations can be made in the fuser roll apparatus of the present invention and in construction of this fuser roll apparatus without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. Apparatus for minimizing heat transfer between the end of the fuser roll and the fuser bearing, comprising:

a general cylindrical collar positionable between the end of the fuser roll and the fuser bearing, the collar having an outer surface contacting the fuser bearing and an inner surface contacting the fuser roll, at least one of the inner surface and the outer surface of the collar including a plurality of protrusions contacting one of the fuser bearing and the fuser roll to reduce heat transfer between the fuser roll and the fuser bearing 2. The apparatus of claim 1, wherein the collar is split so as to form two ends.

3. The apparatus of claim 2, wherein the split collar is twisted so that the two ends are displaced relative to each other along the axial direction of the collar.

4. The apparatus of claim 1, wherein the outer surface of the collar includes a flared surface portion for retaining the fuser bearing.

5. The apparatus of claim 1, wherein both the inner and outer surfaces of the collar include the plurality of the protrusions to reduce heat transfer between the fuser roll and the fuser bearing.

6. The apparatus of claim 1, wherein the outer surface of the collar includes the plurality of protrusions.

7. The apparatus of claim 6, further comprising sliding means for allowing the fuser roll to move axially relative to the collar.

8. The apparatus of claim 7, wherein the sliding means includes a plurality of grooves in the inner surface of the collar, each groove supporting the O-ring seal.

9. The apparatus of claim 1, wherein the collar is composed of an aluminum alloy.

10. The apparatus of claim 1, wherein the inner surface of the collar includes the plurality of protrusions.

11. A fuser apparatus, comprising:

a frame;

a rotatable fuser roll having a longitudinal axis and ends supported by the frame;

a cylindrical bearing circumscribing each end of the fuser roll for rotatably supporting the fuser roll on the frame;

a generally cylindrical collar positioned between one end of the fuser roll and one of the cylindrical bearings; and sliding means, disposed between the collar and the one end of the fuser roll, for allowing the fuser roll to move axially relative to the collar.

12. The apparatus of claim 11, wherein the sliding means includes O-ring seals supported in grooves circumscribing the one end of the fuser roll, the grooves supporting the O-ring seals between the one end of the fuser roll and the collar.

13. The apparatus of claim 11, wherein the sliding means includes O-ring seals supported circumferentially in grooves in the inner surface of the collar.

14. The apparatus of claim 11, wherein the outer surface of the collar includes a plurality of protrusions contacting an inner surface of the cylindrical bearing.

15. The apparatus of claim 11, wherein the collar is composed of an aluminum alloy.

16. A fuser apparatus, comprising:

a frame;

a rotatable fuser roll having a longitudinal axis and ends supported by the frame;

a cylindrical bearing circumscribing each end of the fuser roll for rotatably supporting the fuser roll on the frame; and a generally cylindrical collar having an outer surface contacting one of the cylindrical bearings, and an inner surface contacting the fuser roll, at least one of the inner surfaces and outer surface of the collar including a plurality of protrusions contacting at least one of the fuser roll and the cylindrical bearing to reduce heat transfer between the fuser roll and the cylindrical bearing.

* * * * *